US010692322B2

(12) United States Patent
Hough et al.

(10) Patent No.: US 10,692,322 B2
(45) Date of Patent: Jun. 23, 2020

(54) VENDING MACHINE INTERFACE

(71) Applicant: Intel Corporation, Santa Clara, CA (US)

(72) Inventors: Paul Hough, Shannon (IE); Gabriel Lawrence Silva, Phoenix, AZ (US); Eric R. Auzas, Scottsdale, AZ (US); Kevin Lowell Hudson, Gilbert, AZ (US)

(73) Assignee: Intel Corporation, Santa Clara, CA (US)

( * ) Notice: Subject to any disclaimer, the term of this patent is extended or adjusted under 35 U.S.C. 154(b) by 157 days.

(21) Appl. No.: 15/281,629

(22) Filed: Sep. 30, 2016

(65) Prior Publication Data

US 2018/0096554 A1 Apr. 5, 2018
US 2018/0218560 A9 Aug. 2, 2018

Related U.S. Application Data

(60) Provisional application No. 62/342,624, filed on May 27, 2016.

(51) Int. Cl.
*G07F 9/00* (2006.01)
*G07F 5/10* (2006.01)
(Continued)

(52) U.S. Cl.
CPC ..... *G07F 9/006* (2013.01); *G07F 5/10* (2013.01); *G07F 5/22* (2013.01); *G07F 9/026* (2013.01)

(58) Field of Classification Search
CPC . G07F 9/006; G07F 9/026; G07F 5/10; G07F 5/22
(Continued)

(56) References Cited

U.S. PATENT DOCUMENTS 4,412,292 A * 10/1983 Sedam ..... G06Q 10/087 221/9
4,498,570 A * 2/1985 King ..... G07F 5/24 194/217
(Continued)

FOREIGN PATENT DOCUMENTS

KR 20140108478 9/2014
KR 1020140108478 9/2014
(Continued)

OTHER PUBLICATIONS

"Multi-Drop Bus/Internal Communication Protocol MDB/ICP", NAMA National Automatic Merchandising Association Version 4.2, (Feb. 2011), 313 pgs.
(Continued)

*Primary Examiner* — Michael Collins
(74) *Attorney, Agent, or Firm* — Schwegman Lundberg & Woessner, P.A.

(57) ABSTRACT

Various systems and methods for providing a vending machine interface system are provided herein. A vending machine interface system installed in a vending machine includes a peripheral interface to receive data from a peripheral payment device connected to the vending machine, the data indicating an amount received; an inventory interface to determine a current price of a product; and a vending machine controller interface to transmit a signal to a legacy vending machine controller, the signal causing the vending machine to dispense the product.

25 Claims, 4 Drawing Sheets

(51) Int. Cl.
*G07F 5/22* (2006.01)
*G07F 9/02* (2006.01)

(58) Field of Classification Search
USPC ..... 700/231–244
See application file for complete search history.

(56) References Cited

U.S. PATENT DOCUMENTS 4,679,150 A * 7/1987 Hayashi ..... G07F 9/02 194/217
4,766,548 A * 8/1988 Cedrone ..... G07F 5/18 221/9
5,159,560 A * 10/1992 Newell ..... G06Q 10/08 221/119
5,930,771 A * 7/1999 Stapp ..... G06Q 10/087 705/26.5
6,012,834 A * 1/2000 Dueck ..... G06Q 20/201 700/231
6,021,394 A * 2/2000 Takahashi ..... G06Q 20/203 235/375
6,230,150 B1 * 5/2001 Walker ..... G06Q 10/087 700/231
6,505,095 B1 1/2003 Kolls
6,839,610 B2 * 1/2005 Carstens ..... G07F 9/026 700/236
7,076,329 B1 * 7/2006 Kolls ..... G07F 19/20 700/232
7,131,575 B1 * 11/2006 Kolls ..... G06Q 30/06 235/379
7,593,897 B1 * 9/2009 Kolls ..... G06Q 20/10 235/381
8,596,529 B1 * 12/2013 Kolls ..... G06Q 30/06 235/380
9,153,089 B1 10/2015 Hewett et al.
2003/0158625 A1 * 8/2003 Carstens ..... G07F 9/026 700/236
2004/0059465 A1 * 3/2004 Nickerson ..... G07F 9/026 700/236
2006/0219517 A1 * 10/2006 Cheng ..... G07F 9/026 194/217
2007/0051796 A1 * 3/2007 Yoshizaki ..... G07F 9/026 235/381
2007/0162182 A1 * 7/2007 Marti ..... G07F 9/026 700/236
2007/0227856 A1 10/2007 Gopel
2008/0040211 A1 * 2/2008 Walker ..... G06Q 30/02 705/14.38
2008/0052148 A1 * 2/2008 Walker ..... G06Q 10/087 700/238
2008/0052418 A1 * 2/2008 Marchetti ..... G05B 19/4148 710/7
2010/0094457 A1 * 4/2010 Garson ..... G07F 9/026 700/242
2010/0234986 A1 * 9/2010 Clopton ..... G06Q 10/087 700/236
2015/0100152 A1 * 4/2015 Barragan Trevino ... G07F 9/026 700/232
2018/0005167 A1 * 1/2018 Smith ..... G06Q 10/08

FOREIGN PATENT DOCUMENTS

WO 2006021825 3/2006
WO 2009006705 1/2009
WO 2012100306 8/2012
WO 2013078373 5/2013

OTHER PUBLICATIONS

"International Application Serial No. PCT/US2017/031254, International Search Report dated Aug. 8, 2017", 10 pgs.
"International Application Serial No. PCT/US2017/031254, Written Opinion dated Aug. 8, 2017", 7 pgs.
"International Application Serial No. PCT US2017 031254, International Preliminary Report on Patentability dated Dec. 6, 2018", 9 pgs.
"European Application Serial No. 17803264.5, Extended European Search Report dated Nov. 27, 2019", 8 pgs.

* cited by examiner

VENDING MACHINE INTERFACE

CLAIM OF PRIORITY

This patent application claims the benefit of priority U.S. Provisional Patent Application Ser. No. 63/342,624, entitled "Vending Machine Interface," filed on May 27, 2016, which is hereby incorporated by reference herein in its entirety.

TECHNICAL FIELD

Embodiments described herein generally relate to vending machine controllers and in particular, to a vending machine interface.

BACKGROUND

A vending machine is a machine that receives currency or other credit from a person, and in return, dispenses things such as food, beverages, cigarettes, tickets, candy, movies, or other such items.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

In the following description, for purposes of explanation, numerous specific details are set forth in order to provide a thorough understanding of some example embodiments. It will be evident, however, to one skilled in the art that the present disclosure may be practiced without these specific details.

Disclosed herein are systems and methods that provide a vending machine interface system. Conventionally, vending machines are stand-alone machines that are not networked. These types of machines require many man hours to visit each machine, check its stock, program item prices or quantities for dispensing, and otherwise maintain the machine. Vending operators have large fleets of vending machines that are expensive to operate and maintain.

Many vending machines have long service lives, with some being in use for years or even decades. Vending operators who wish to take advantage of the increased wireless connectivity that is found nearly everywhere in modern environments, create digital advertising, or process different forms of payment (e.g., cashless payments), are faced with the decision of whether to replace existing vending machine units with new ones or forego these advances. An alternative to a complete machine replacement is a retrofit. The present disclosure discusses an efficient and powerful mechanism to retrofit existing vending machines in a manner that allows them to provide new services.

Figure 1:
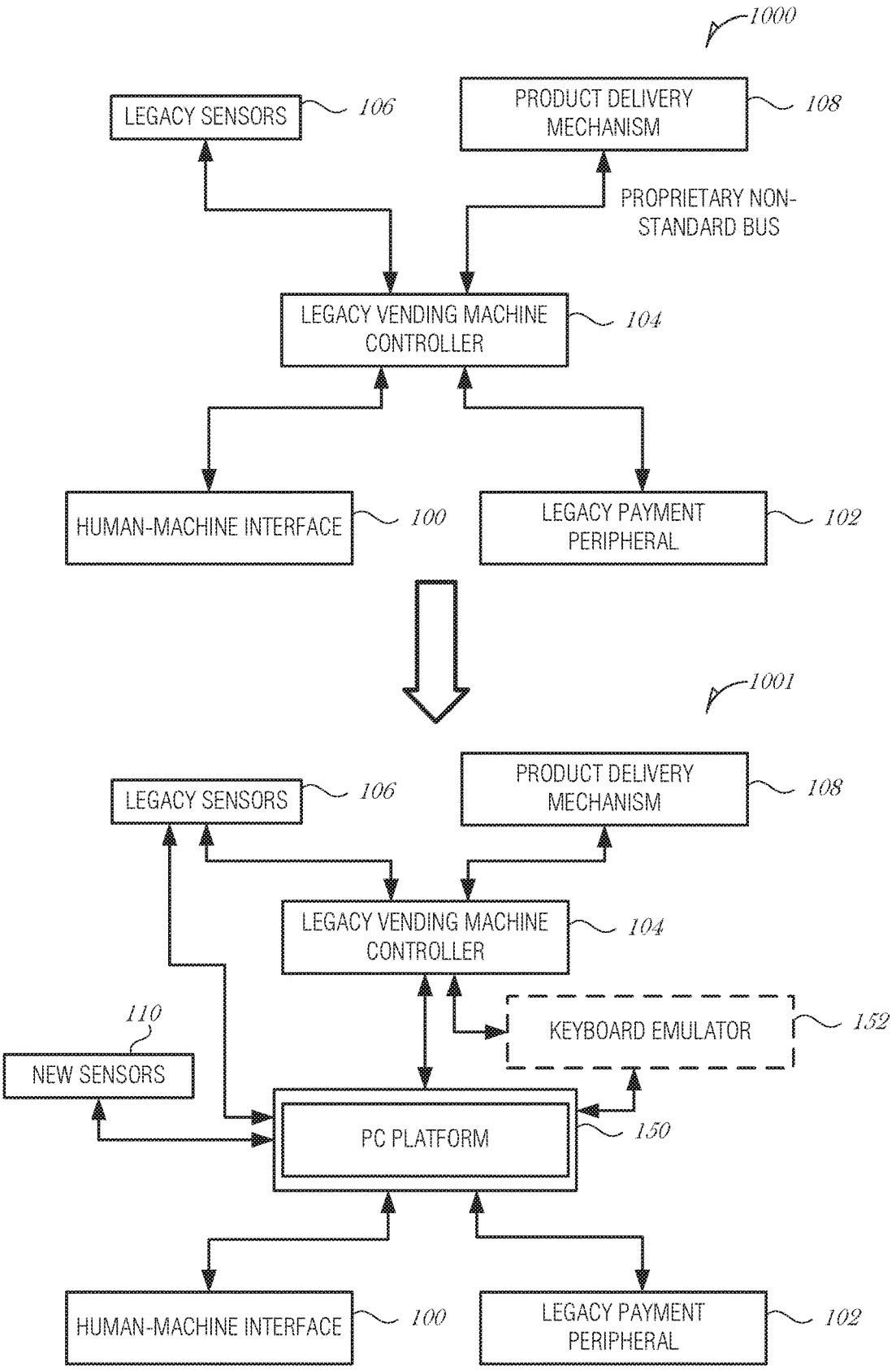
FIG. 1 is a block diagram illustrating a vending machine retrofit, according to an embodiment.

FIG. 1 is a block diagram illustrating a vending machine retrofit, according to an embodiment. FIG. 1 illustrates a legacy vending machine architecture 1000, including a human-machine interface 100, a legacy payment peripheral 102, each of which interface with a legacy vending machine controller (VMC) 104. The VMC 104 is coupled to legacy sensors 106 and a product delivery mechanism 108. When a consumer wants to purchase or obtain a product from the vending machine, the consumer interacts with the human-machine interface 100. The human-machine interface 100 may include various types of controls, such as punch buttons, a liquid crystal display (LCD), a keypad, or other inputs to control the selection of the product the consumer wishes to obtain. If there is a cost to obtain the product, then the consumer may insert various types of currency or credits. The legacy payment peripheral 102 may include a bill acceptor, coin acceptor, a credit card reader, or other mechanism to receive currency or credits from the consumer.

The VMC 104 registers various activities in the vending machine and controls whether a product is dispensed via the product delivery mechanism 108. The product delivery mechanism 108 may be any mechanical, electromechanical, or other mechanism to control dispensing of products or items in a vending machine. Examples of a product delivery mechanism 108 include, but are not limited to an x-y motor assembly, spiral motor mechanism, flip mechanism, or the like.

The VMC 104 may also monitor sensor data from legacy sensors 106 to determine product availability, dispensing jams, and other indicators of the vending machine status. The legacy sensors 106 may include various contact switches, positional sensors, infrared sensors, or the like to determine the status of, or monitor the status of, various aspects of the vending machine. For example, a sensor 106 may indicate when a product is out of stock, or when a product gets stuck, or when a product is dropped, or when a service door is open. Legacy sensors may include, but are not limited to drop sensors, temperature sensors, optical sensors, tilt sensors, or the like.

The VMC 104 receives payment via the legacy payment peripheral 102, the product selection via the human-machine interface 100, and then triggers the product delivery mechanism 108 when the conditions are right. A drop sensor may be used to determine whether the product dispensed. The drop sensor may be coupled to the VMC 104. If no product was dispensed, then the product spiral may be empty. Various remedial operations may occur in this case, such as allowing the consumer to input a different selection, providing change, or sounding an alert, for example. The VMC 104 may also cause the payment peripheral to dispense change when the amount of currency inserted was more than the purchase price, and update the human-machine interface 100 to show a successful transaction. It is understood that the preceding example is non-limiting, and that other configurations and interactions are considered to be within the scope of this disclosure.

FIG. 1 also illustrates a retrofitted vending machine architecture 1001. In the retrofitted vending machine architecture 1001, a personal computer (PC) platform 150 is inserted between certain components of the legacy vending machine architecture 1000 so that signals from the human-machine interface 100 and the legacy payment peripheral 102 are routed through the PC platform 150 to the VMC 104. The PC platform 150 may present itself as a legacy vending payment peripheral type to the VMC 104. In this manner, the PC platform 150 may capture payment information from the legacy payment peripheral 102 and then pass through the same or different information to the VMC 104. Various payment protocols may be used, such as MDB (Multi-Drop Bus), Protocol A (also known as Executive), ccTalk, BDV, Micromech, Simplex III, Simplex 0, VCCS, HII, or the like. Price adjustments and other functions are described below.

Additionally, the PC platform 150 may provide emulated human-machine interface information to the VMC 104. For example, when the human-machine interface 100 takes the form of a keypad, the keypad information may be transmitted to the VMC 104 so that the VMC 104 responds as though the VMC 104 received the keypad signals directly from the human-machine interface 100. For instance, keypads are often used in vending for product selection and this may be sensed by the PC platform 150 thru general purpose inputs (GPIs) arranged in an XY matrix. When a specific key on the keypad is pressed, the keypad pulls two GPIs low, for example, which denotes the selection.

In addition, legacy sensors 106 and new sensors 110 may be coupled to the PC platform 150. The legacy sensors 106 may be decoupled from the VMC 104 in some installations. In such a configuration, some sensor values from the legacy sensors 106 may be routed through the PC platform 150 to the VMC 104 in order to trigger certain operations, for example. The drop sensor may be initially coupled to the VMC 104. After a retrofit, the drop sensor may be decoupled from the VMC 104 and may be coupled to the PC platform 150. When an item is dropped for vending, the PC platform 150 may detect the drop and send a signal to the VMC 104. In this manner the PC platform 150 may perform additional or auxiliary operations when the drop sensor is activated. For instance, the PC platform 150 may perform accounting functions, inventor functions, user interface functions, etc. in response to the drop sensor triggering.

New sensors 110 may be installed at the time of the retrofit and coupled to the PC platform 150. The new sensors 110 may be used solely for the PC platform 150 or may be used to augment capabilities provided by the VMC 104. Examples of legacy and new sensors 110 include, but are not limited to proximity sensors, biometric sensors, cameras, diagnostic sensors, voltage sensors, current sensors, water flowrate sensors, and the like.

To modify a legacy vending machine architecture 1000 to a retrofitted vending machine architecture 1001, the existing user-inputs, such as an existing LCD, keypad, payment peripherals (e.g., coin mechanism or bill validator), are disconnected from the legacy VMC 104. If the retrofit includes adding a new screen for advertising, product information/selection, etc., then the touchscreen is installed and connected to the PC platform 150. Alternatively a second, larger screen may be added for increased advertisement availability leading to increased value of the advertisement space. The PC platform 150 may drive both screens with the content of each able to be controlled via software and changed remotely. If instead a headless retrofit is to be used, then the previously installed legacy user-inputs (e.g., LCD screen or keypad) may be connected to the PC platform 150. The PC platform 150 may be equipped with ports, connections, circuits, plugs, or other electrical or electromechanical interfaces to connect with legacy equipment. The PC platform 150 may be embedded in the vending machine, and thus referred to as an "embedded PC platform," in some embodiments. The PC platform 150 may take on various forms including, but not limited to a mobile computer, a mini PC, an industrial PC, a box PC, a gateway controller, or any other compute system that is implemented as part of a larger system.

General purpose outputs (GPO) of the PC platform 150 are used to drive the keypad interface on the VMC 104. The GPOs will drive two outputs low to emulate a product selection on the keypad. Alternatively, the PC platform 150 may communicate with the VMC 104 using a keypad emulator 152 (e.g., a relay board).

The PC platform 150 is then connected to the VMC 104. In an example, the PC platform 150 is connected using an MDB connection and the PC platform 150 is configured to transmit MDB signals over the connection. Of course, other connection types and protocols may be used. The legacy payment peripherals like coin/bill acceptors are then connected to the PC platform 150.

The term "legacy price" or "legacy pricing" refers to the price that was used before the retrofit. The legacy price may be stored in local storage (on the old hardware). Legacy pricing may be obtained as part of the retrofit procedure, such as by selecting each product and recording the price displayed on the front panel of the vending machine, or by using DEX with an interface tool to obtain legacy machine status information such as prices, stock levels, or machine health. An association between legacy pricing and current pricing is then made and stored in the PC platform 150. The legacy pricing (e.g., existing pricing at the time of the retrofit) may be maintained using the PC platform 150 to map revised pricing to legacy pricing and providing the appropriate signals to the VMC 104 to dispense the product.

Alternatively, legacy pricing may be reset to zero currency (e.g., $0.00). In this case, the PC platform 150 does not need to maintain a mapping between the current pricing and legacy pricing. When prices are zero, a free vend is accessed and the VMC 104 automatically dispenses the product when a product selection is received.

As another alternative, instead of setting prices to zero, a test vend signal may be sent from the PC platform 150 to the VMC 104 to dispense a product. The PC platform 150 is used to receive and validate the payment. When appropriate payment is received for the product selection, the PC platform 150 sends a test vend signal to the VMC 104 with the appropriate product selection. The PC platform 150 may send a test vend signal to the VMC 104 through the keyboard emulator 152 or using GPO. In this manner, neither the PC platform 150 nor the VMC 104 needs to maintain a price mapping between current prices and legacy prices.

Figure 2:
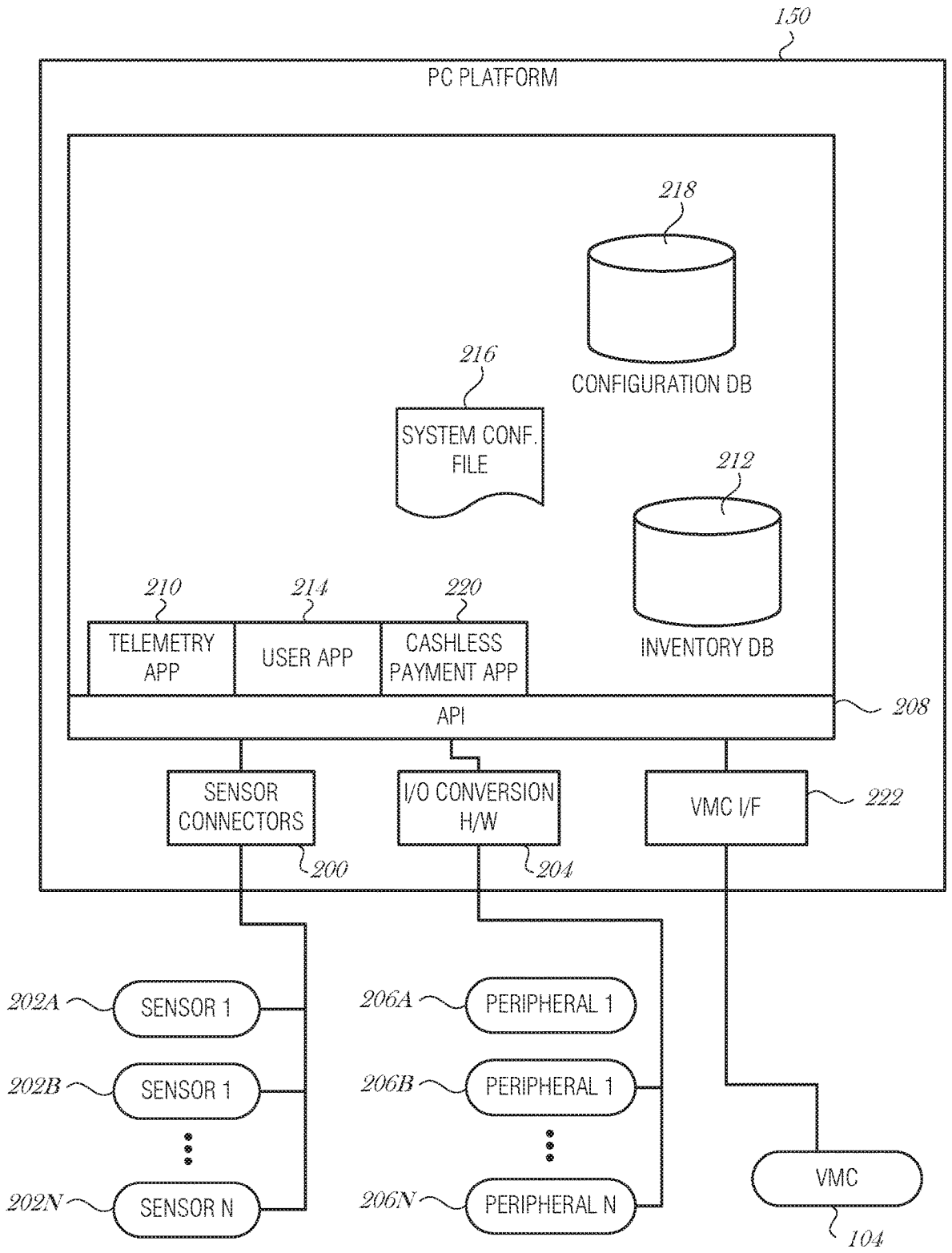
FIG. 2 is a block diagram illustrating a PC platform, according to an embodiment.

FIG. 2 is a block diagram illustrating an PC platform 150, according to an embodiment. The PC platform 150 includes one or more sensor connectors 200 able to receive sensor data from sensors 202A-N. Sensors 202A-N may include various sensors installed on a legacy vending machine or those installed with the retrofit procedure. Sensors 202A-N include door sensors, product quantity sensors, temperature sensors, impact sensors, and the like. The sensor connectors 200 may include various connectors such as I2C, USB, RS232, SPI, or the like.

The PC platform 150 also includes an input/output (I/O) conversion hardware (H/W) 204 to interface with one or more peripheral devices 206A-N. I/O conversion H/W 204 acts as a peripheral interface (I/F) and is used so that the PC platform 150 is able to communicate with legacy peripherals using legacy protocols, such as MDB, CAN, ccTalk, and the like. Peripherals 206A-N may include devices such as bill acceptors, coin acceptors, card readers, keypads, and the like.

Data and information received from sensors 202A-N and peripherals 206A-N may be translated in an application programming interface (API) 208 and made available for consumption by one or more applications executing on the PC platform 150.

A telemetry application 210 is configured to receive data from the sensors 202A-N and peripherals 206A-N. Some or all of data may be stored in an inventory database 212. The inventory database 212 may store information about the vending machine's contents, sales, cash in, cash out, prices, and the like.

A user application 214 is configured to interface with a user, such as with a user interface presented on a legacy LCD screen or on a retrofit replacement touchscreen, for example. The user application 214 allows the vending machine administrator to manage the sensors 202A-N and peripherals 206A-N connected to the vending machine, such as to enable or disable peripheral devices, perform tests or checks of the vending machine, and the like. A system configuration file 216 may be stored with user preferences as set via the user application 214. Historical and other status information may be stored in a configuration database 218.

In the system shown in FIG. 2, a cashless payment application 220 is installed in the PC platform 150. Cashless payments include payment modalities such as near-field communication (NFC) payment solutions. While legacy vending machines may not provide the ability to accept such forms of payment, the retrofit PC platform 150 may be configured with one or more radios and other circuitry to detect a contactless payment method (e.g., NFC wallet), connect with a payment clearinghouse to obtain payment authorization, and then communicate with the legacy VMC 104 to complete the sale and dispense the product. Cashless payment may be administered via the user application 214.

Although three applications are illustrated in FIG. 2, it is understood that additional applications may be used to modify or expand the functionality of the PC platform 150.

The inventory database 212 may be configured to maintain different pricing entries for a single product. The inventory database 212 may include at least two pricing entries, one that reflects the legacy pricing and another that reflects the advertised price. In this way, for the price substitution configuration discussed above in FIG. 1, the retrofit vending machine is able to display a product at certain price (e.g., $0.50), receive the proper amount of money or credit for the product, communicate the legacy price (e.g., $0.35) to the VMC 104, and in doing so provide the VMC 104 with the expected amount for the product. The VMC 104, after having received the correct amount of money or credit will then dispense the product. The PC platform 150 controls the advertised price and may alter the advertised price without having to reprogram or reconfigure the underlying legacy VMC 104.

As discussed above, when a test vend signal mode is used, or when the legacy prices are set to zero, the inventory database 212 does not need to include the mapping between the legacy and advertised prices. However, it is understood that the inventory database 212 may include such information, for example when the same inventory database 212 is used for several machines with different configurations.

With the radios and other communication circuitry, the PC platform 150 is able to receive price changes from a remote location (e.g., a central office), and put price changes into effect in the field immediately. The use of temporary prices, discounts, coupons, frequent shopper rewards, and other incentives and offers may be electronically controlled and easily overlaid on the legacy VMC 104. Prices may vary based on the amount of remaining stock, the shelf life of the stock, events in the venue where the vending machine is installed, time of day, or any other marketing basis.

Accounting may be managed at the vending machine, such as in the inventory database 212 or telemetered to a remote location (e.g., a central office). Various accounting and other management techniques may be used to determine trends in product sales, pricing effects on sales, geographical trends on sales, and the like. Additionally, sensor data may be telemetered to alert a vending machine operator that an item is running low or has been sold out.

A VMC interface (I/F) 222 is used to communicate with the VMC 104. Several channels of communication may be provided between the VMC I/F 222 and the VMC 104, as discussed above, for example a keypad selection general purpose output (GPO), or payment information using a vending machine communication protocol. Additionally, sensor information may be obtained at the PC platform 150 and transmitted to the VMC 104 via the VMC I/F 222.

Thus, in an embodiment, a vending application running on the PC platform 150 maintains different pricing entries in a database, one for the legacy pricing that the VMC is programmed to accept in order to dispense, and the other with the "new" pricing that is presented to the customer. The User Interface for product selection is provided by a touchscreen or LCD/Keypad combination connected to the PC platform 150. A user selects a product at the "new" pricing maintained on PC platform 150. The user pays for product via cashless, coins, or notes. The payment options are a combination of new methods provided by the PC platform 150 and the legacy payment peripherals which are now also connected to the PC platform 150. Once payment is received, the product selection is relayed by the PC platform 150 thru its GPOs to the keypad interface of the legacy VMC 104. The VMC 104 now knows which product it should vend. Next, payment is communicated at the "old" pricing to the legacy VMC 104 via the PC platform 150 emulating one of the legacy payment peripherals (coin mech, bill validator etc.) thru its slave interface.

As an example, the slave interface may be MDB. The MDB protocol supports many ways to send this data. As an illustrative example, assume that the legacy cost of product is $0.70. The PC platform 150 at power up has presented itself to the legacy VMC 104 as a coin mech. It does this by responding to polls to address 08H from the VMC 104. The PC platform 150 then responds to a VMC poll with 0x44 0x04 to indicate $0.20 in coins was deposited. The PC platform 150 responds to a subsequent poll with 0x48 0x08 to indicate $0.50 in coins was deposited. The legacy VMC 104 has now been informed the full payment has been received and dispenses the product. Product is then delivered via the legacy product delivery mechanism.

Alternatively, the PC platform 150 may use a keypad emulator or GPO to transmit product selections, which when the legacy VMC 104 is properly configured, causes the vending machine to dispense the product. The PC platform 150 may instead use a test vend signal to cause the product dispensing.

Figure 3:
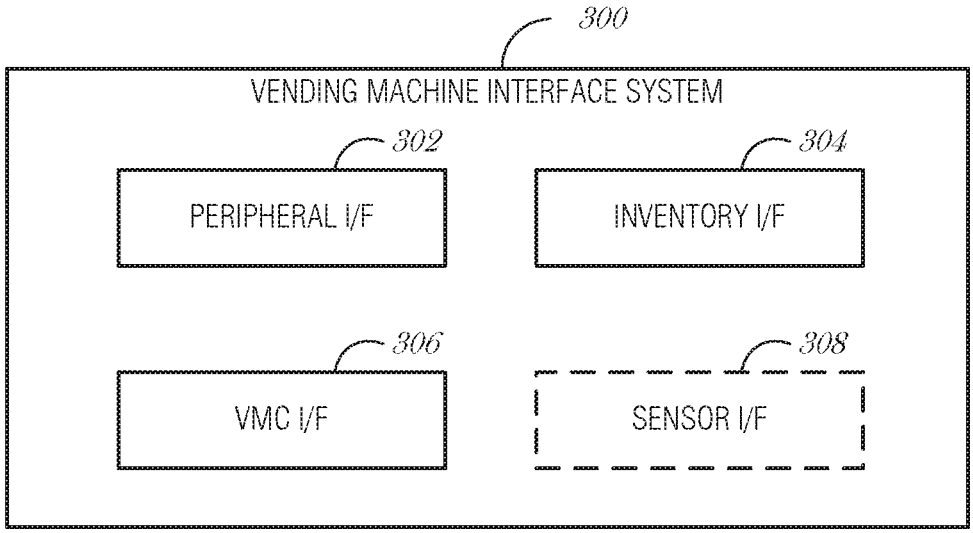
FIG. 3 is a block diagram illustrating a vending machine interface system installed in a vending machine, according to an embodiment.

FIG. 3 is a block diagram illustrating a vending machine interface system 300 installed in a vending machine, according to an embodiment. The vending machine interface system 300 may be the PC platform 150, in an embodiment. In the example illustrated in FIG. 3, the system 300 includes a peripheral interface 302, an inventory interface 304, and a vending machine controller interface 306.

The peripheral interface 302, inventory interface 304, vending machine controller interface 306, and sensor interface 308 are understood to encompass tangible entities that are physically constructed, specifically configured (e.g., hardwired), or temporarily (e.g., transitorily) configured (e.g., programmed) to operate in a specified manner or to perform part or all of any operations described herein. Such tangible entitles may be constructed using one or more circuits, such as with dedicated hardware (e.g., field programmable gate arrays (FPGAs), logic gates, graphics processing unit (GPU), a digital signal processor (DSP), etc.). As such, the tangible entities described herein may be referred to as circuits, circuitry, processor units, subsystems, or the like.

The peripheral interface 302, inventory interface 304, vending machine controller interface 306, or sensor interface 308 may be incorporated into a computing platform, such as one illustrated in FIG. 5 and discussed below.

The peripheral interface 302 may be configured to receive data from a peripheral payment device connected to the vending machine, the data indicating an amount received.

The inventory interface 304 may be configured to determine a current price of a product. In some embodiments, the inventory interface 304 is also used to access a corresponding legacy price of the product. An example inventory interface 304 includes a DEX (digital exchange) port, where various status data may be extracted from a legacy VMC 104 (e.g., sales, stock, or diagnostic information). The current price is the advertised price, and may be stored in an inventory database. The inventory database may be stored in the vending machine interface system 300 or remote from the system 300.

The vending machine controller interface 306 may be configured to transmit a signal to a legacy vending machine controller, the signal causing the vending machine to dispense the product. The vending machine interface system may be used to provide price substitution such that legacy pricing need not be changed when retrofitting the vending machine. As such, in an embodiment, the signal indicates that the amount received via the peripheral interface is at least that of the corresponding legacy price in order to cause the legacy vending machine controller to dispense the product.

In other embodiments, the legacy pricing is not changed and instead the legacy vending machine controller is signaled to dispense a product using a test vend signal. As such, in an embodiment, the signal from the vending machine controller interface to the legacy vending machine controller comprises a test vend signal.

In other embodiments, the legacy pricing is reset to zero (e.g., $0.00) so that every product is effectively free. The retrofit vending machine control is then used to monitor cash in and control product dispensing. As such, in an embodiment, the legacy vending machine controller is configured with a legacy price of zero for the product, and the signal is a product selection signal. When the product is set to "free", the product selection signal alone causes the product to dispense.

The vending machine controller interface 306 may be configured to communicate with a legacy vending machine controller of the vending machine, the vending machine controller interface to transmit an indication that the amount received via the peripheral interface is equal to the legacy price.

In an embodiment, the peripheral payment device is at least one of: a bill acceptor, a coin acceptor, or a card reader. The peripheral payment device may be other types of devices, such as a near-field communication receiver, which may receive signals from a smartphone, a mobile device, or a wearable device of the user, for example. As another example, the peripheral payment device may be a network receiver to receive a signal from a transmitter, such as a Bluetooth or Wi-Fi transmitter on a user device. The peripheral payment device may then communicate over a payment network to validate and authorize payment.

In an embodiment, the current price of the product and the corresponding legacy price of the product are different amounts. Of course, the current price and legacy price may be the same as well in some embodiments.

In an embodiment, the system 300 further comprises a sensor interface 308 to receive sensor data from a sensor installed in the vending machine. In a further embodiment, the sensor data indicates stock level of a product vended from the vending machine. In another embodiment, the sensor data indicates temperature of an interior space of the vending machine. In a further embodiment, the system 300 is to communicate the sensor data to a remote location. In a related embodiment, the system 300 is to communicate the sensor data indicating stock level to a remote location to alert the remote location of a need to restock. Stock information may be kept locally at the vending machine, in combination with remote storage, or instead of remote storage.

In an embodiment, the peripheral interface 302 is connected with a human-machine interface of the vending machine, the human-machine interface used to select a product to vend from the vending machine. In an embodiment, the human-machine interface is a keypad. In a further embodiment, the peripheral interface 302 is to receive a product selection from the human-machine interface, and the vending machine controller interface 306 is configured to communicate the product selection to the legacy vending machine controller.

Figure 4:
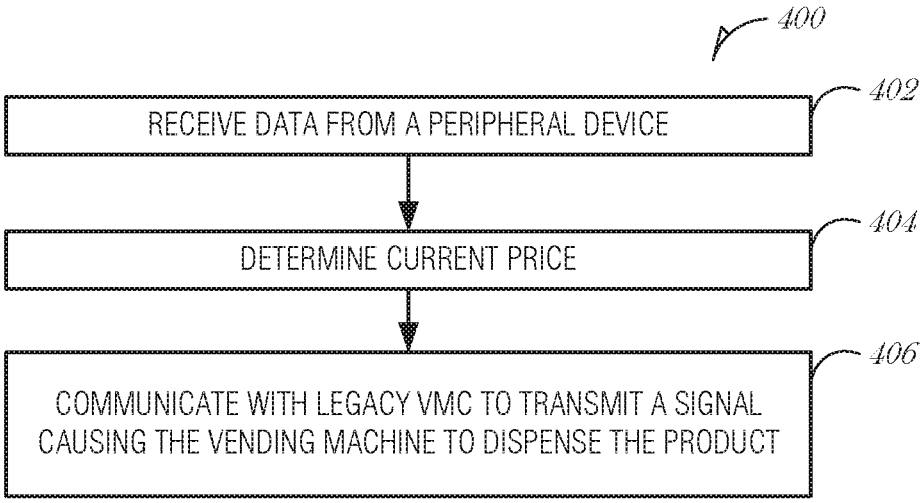
FIG. 4 is a flowchart illustrating a method for providing a vending machine interface system installed in a vending machine, according to an embodiment.

FIG. 4 is a flowchart illustrating a method 400 for providing a vending machine interface system installed in a vending machine, according to an embodiment. At block 402, data from a peripheral payment device connected to the vending machine interface system, is received at the vending machine interface system, the data indicating an amount received. In an embodiment, the peripheral payment device is at least one of: a bill acceptor, a coin acceptor, or a card reader.

At block 404, a current price of a product is determined. In an embodiment, a corresponding legacy price of the product is accessed. In an embodiment, the current price of the product and the corresponding legacy price of the product are different amounts.

At block 406, the method 400 includes communicating with a legacy vending machine controller of the vending machine to transmit a signal to the legacy vending machine controller, the signal causing the vending machine to dispense the product.

In an embodiment, the signal indicates that the amount received via the peripheral interface is at least that of the corresponding legacy price in order to cause the legacy vending machine controller to dispense the product.

In another embodiment, the signal comprises a test vend signal.

In yet another embodiment, the legacy vending machine controller is configured with a legacy price of zero for the product, and the signal is a product selection signal.

In an embodiment, the method 400 includes receiving sensor data from a sensor installed in the vending machine. In a further embodiment, the sensor data indicates stock level of a product vended from the vending machine. In a related embodiment, the sensor data indicates temperature of an interior space of the vending machine.

In a further embodiment, the method 400 includes communicating the sensor data to a remote location. In a further embodiment, communicating the sensor data to the remote location comprises communicating the sensor data indicating stock level to a remote location to alert the remote location of a need to restock.

In an embodiment, the method 400 includes establishing connection with a human-machine interface of the vending machine. In a further embodiment, the human-machine interface is a keypad. In a related embodiment, the method 400 includes receiving a product selection from the human-machine interface and communicating the product selection to the legacy vending machine controller.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

A processor subsystem may be used to execute the instruction on the machine-readable medium. The processor subsystem may include one or more processors, each with one or more cores. Additionally, the processor subsystem may be disposed on one or more physical devices. The processor subsystem may include one or more specialized processors, such as a graphics processing unit (GPU), a digital signal processor (DSP), a field programmable gate array (FPGA), or a fixed function processor.

Examples, as described herein, may include, or may operate on, logic or a number of components, modules, or mechanisms. Modules may be hardware, software, or firmware communicatively coupled to one or more processors in order to carry out the operations described herein. Modules may be hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Circuitry or circuits, as used in this document, may comprise, for example, singly or in any combination, hardwired circuitry, programmable circuitry such as computer processors comprising one or more individual instruction processing cores, state machine circuitry, and/or firmware that stores instructions executed by programmable circuitry. The circuits, circuitry, or modules may, collectively or individually, be embodied as circuitry that forms part of a larger system, for example, an integrated circuit (IC), system on-chip (SoC), desktop computers, laptop computers, tablet computers, servers, smart phones, etc.

Figure 5:
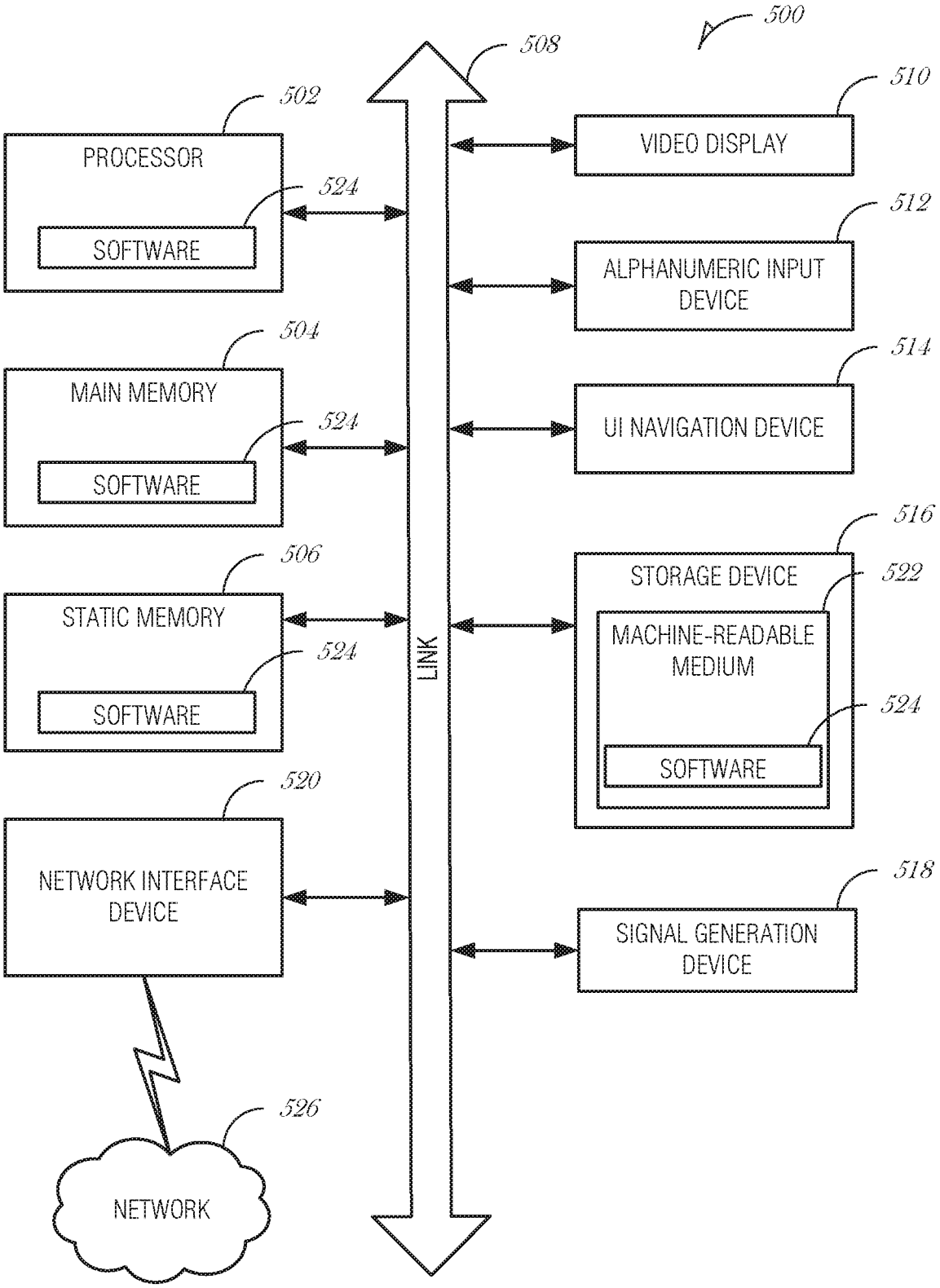
FIG. 5 is a block diagram illustrating an example machine upon which any one or more of the techniques (e.g., methodologies) discussed herein may perform, according to an example embodiment.

FIG. 5 is a block diagram illustrating a machine in the example form of a computer system 500, within which a set or sequence of instructions may be executed to cause the machine to perform any one of the methodologies discussed herein, according to an example embodiment. The computer system 500 may form part or all of the PC platform 150. In alternative embodiments, the computer system 500 operates as a standalone device or may be connected (e.g., networked) to other machines. In a networked deployment, the computer system 500 may operate in the capacity of either a server or a client machine in server-client network environments, or it may act as a peer machine in peer-to-peer (or distributed) network environments. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 500 includes at least one processor 502 (e.g., a central processing unit (CPU), a graphics processing unit (GPU) or both, processor cores, compute nodes, etc.), a main memory 504 and a static memory 506, which communicate with each other via a link 508 (e.g., bus). The computer system 500 may further optionally include a video display unit 510, an alphanumeric input device 512 (e.g., a keyboard), and a user interface (UI) navigation device 514 (e.g., a mouse), depending on the installation details of the PC platform 150. In one embodiment, the video display unit 510, input device 512 and UI navigation device 514 are incorporated into a touch screen display. The computer system 500 may additionally include a storage device 516 (e.g., a drive unit), a signal generation device 518 (e.g., a speaker), a network interface device 520, and one or more sensors (not shown), such as a global positioning system (GPS) sensor, compass, accelerometer, gyrometer, magnetometer, or other sensor.

The storage device 516 includes a machine-readable medium 522 on which is stored one or more sets of data structures and instructions 524 (e.g., software) embodying or utilized by any one or more of the methodologies or functions described herein. The instructions 524 may also reside, completely or at least partially, within the main memory 504, static memory 506, and/or within the processor 502 during execution thereof by the computer system 500, with the main memory 504, static memory 506, and the processor 502 also constituting machine-readable media.

While the machine-readable medium 522 is illustrated in an example embodiment to be a single medium, the term "machine-readable medium" may include a single medium or multiple media (e.g., a centralized or distributed database, and/or associated caches and servers) that store the one or more instructions 524. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices, magnetic disks such as internal hard disks and removable disks; magneto-optical disks; and CD-ROM and DVD-ROM disks.

The instructions 524 may further be transmitted or received over a communications network 526 using a transmission medium via the network interface device 520 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Bluetooth, Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

ADDITIONAL NOTES & EXAMPLES

Example 1 is a vending machine interface system installed in a vending machine, the system comprising: a peripheral interface to receive data from a peripheral payment device connected to the vending machine, the data indicating an amount received, an inventory interface to determine a current price of a product; and a vending machine controller interface to transmit a signal to a legacy vending machine controller, the signal causing the vending machine to dispense the product.

In Example 2, the subject matter of Example 1 optionally includes wherein the peripheral payment device is at least one of: a bill acceptor, a coin acceptor, or a card reader.

In Example 3, the subject matter of any one or more of Examples 1-2 optionally include wherein the inventory interface is to access a corresponding legacy price of the product.

In Example 4, the subject matter of Example 3 optionally includes wherein the current price of the product and the corresponding legacy price of the product are different amounts.

In Example 5, the subject matter of any one or more of Examples 3-4 optionally include wherein the signal indicates that the amount received via the peripheral interface is at least that of the corresponding legacy price in order to cause the legacy vending machine controller to dispense the product.

In Example 6, the subject matter of any one or more of Examples 1-5 optionally include wherein the signal comprises a test vend signal.

In Example 7, the subject matter of any one or more of Examples 1-6 optionally include wherein legacy vending machine controller is configured with a legacy price of zero for the product, and wherein the signal is a product selection signal.

In Example 8, the subject matter of any one or more of Examples 1-7 optionally include wherein the system further comprises a sensor interface to receive sensor data from a sensor installed in the vending machine.

In Example 9, the subject matter of Example 8 optionally includes wherein the sensor data indicates stock level of a product vended from the vending machine.

In Example 10, the subject matter of any one or more of Examples 8-9 optionally include wherein the sensor data indicates temperature of an interior space of the vending machine.

In Example 11, the subject matter of any one or more of Examples 8-10 optionally include wherein the system is to communicate the sensor data to a remote location.

In Example 12, the subject matter of Example 11 optionally includes wherein the system is to communicate the sensor data indicating stock level to a remote location to alert the remote location of a need to restock.

In Example 13, the subject matter of any one or more of Examples 1-12 optionally include wherein the peripheral interface is connected to a human-machine interface of the vending machine, the human-machine interface used to select a product to vend from the vending machine.

In Example 14, the subject matter of Example 13 optionally includes wherein the human-machine interface is a keypad.

In Example 15, the subject matter of any one or more of Examples 13-14 optionally include wherein the peripheral interface is to receive a product selection from the human-machine interface, and wherein the vending machine controller interface is to communicate the product selection to the legacy vending machine controller.

Example 16 is a method of providing a vending machine interface system installed in a vending machine, the method comprising: receiving data at the vending machine interface system, from a peripheral payment device connected to the vending machine interface system, the data indicating an amount received; determining a current price of a product; and communicating with a legacy vending machine controller of the vending machine to transmit a signal to the legacy vending machine controller, the signal causing the vending machine to dispense the product.

In Example 17, the subject matter of Example 16 optionally includes wherein the peripheral payment device is at least one of: a bill acceptor, a coin acceptor, or a card reader.

In Example 18, the subject matter of any one or more of Examples 16-17 optionally include accessing a corresponding legacy price of the product.

In Example 19, the subject matter of Example 18 optionally includes wherein the current price of the product and the corresponding legacy price of the product are different amounts.

In Example 20, the subject matter of any one or more of Examples 18-19 optionally include wherein the signal indicates that the amount received via the peripheral interface is at least that of the corresponding legacy price in order to cause the legacy vending machine controller to dispense the product.

In Example 21, the subject matter of any one or more of Examples 16-20 optionally include wherein the signal comprises a test vend signal.

In Example 22, the subject matter of any one or more of Examples 16-21 optionally include wherein the legacy vending machine controller is configured with a legacy price of zero for the product, and wherein the signal is a product selection signal.

In Example 23, the subject matter of any one or more of Examples 16-22 optionally include receiving sensor data from a sensor installed in the vending machine.

In Example 24, the subject matter of Example 23 optionally includes wherein the sensor data indicates stock level of a product vended from the vending machine.

In Example 25, the subject matter of any one or more of Examples 23-24 optionally include wherein the sensor data indicates temperature of an interior space of the vending machine.

In Example 26, the subject matter of any one or more of Examples 23-25 optionally include communicating the sensor data to a remote location.

In Example 27, the subject matter of Example 26 optionally includes wherein communicating the sensor data to the remote location comprises communicating the sensor data indicating stock level to a remote location to alert the remote location of a need to restock.

In Example 28, the subject matter of any one or more of Examples 16-27 optionally include establishing connection with a human-machine interface of the vending machine.

In Example 29, the subject matter of Example 28 optionally includes wherein the human-machine interface is a keypad.

In Example 30, the subject matter of any one or more of Examples 28-29 optionally include receiving a product selection from the human-machine interface; and communicating the product selection to the legacy vending machine controller.

Example 31 is at least one machine-readable medium including instructions, which when executed by a machine, cause the machine to perform operations of any of the methods of Examples 16-30.

Example 32 is an apparatus comprising means for performing any of the methods of Examples 16-30.

Example 33 is a vending machine interface system installed in a vending machine comprising: means for receiving data at the vending machine interface system, from a peripheral payment device connected to the vending machine interface system, the data indicating an amount received; means for determining a current price of a product; and means for communicating with a legacy vending machine controller of the vending machine to transmit a signal to the legacy vending machine controller, the signal causing the vending machine to dispense the product.

In Example 34, the subject matter of Example 33 optionally includes wherein the peripheral payment device is at least one of: a bill acceptor, a coin acceptor, or a card reader.

In Example 35, the subject matter of any one or more of Examples 33-34 optionally include means for accessing a corresponding legacy price of the product.

In Example 36, the subject matter of Example 35 optionally includes wherein the current price of the product and the corresponding legacy price of the product are different amounts.

In Example 37, the subject matter of any one or more of Examples 35-36 optionally include wherein the signal indicates that the amount received via the peripheral interface is at least that of the corresponding legacy price in order to cause the legacy vending machine controller to dispense the product.

In Example 38, the subject matter of any one or more of Examples 33-37 optionally include wherein the signal comprises a test vend signal.

In Example 39, the subject matter of any one or more of Examples 33-38 optionally include wherein the legacy vending machine controller is configured with a legacy price of zero for the product, and wherein the signal is a product selection signal.

In Example 40, the subject matter of any one or more of Examples 33-39 optionally include means for receiving sensor data from a sensor installed in the vending machine.

In Example 41, the subject matter of Example 40 optionally includes wherein the sensor data indicates stock level of a product vended from the vending machine.

In Example 42, the subject matter of any one or more of Examples 40-41 optionally include wherein the sensor data indicates temperature of an interior space of the vending machine.

In Example 43, the subject matter of any one or more of Examples 40-42 optionally include means for communicating the sensor data to a remote location.

In Example 44, the subject matter of Example 43 optionally includes wherein the means for communicating the sensor data to the remote location comprise means for communicating the sensor data indicating stock level to a remote location to alert the remote location of a need to restock.

In Example 45, the subject matter of any one or more of Examples 33-44 optionally include means for establishing connection with a human-machine interface of the vending machine.

In Example 46, the subject matter of Example 45 optionally includes wherein the human-machine interface is a keypad.

In Example 47, the subject matter of any one or more of Examples 45-46 optionally include means for receiving a product selection from the human-machine interface; and means for communicating the product selection to the legacy vending machine controller.

Example 48 is at least one machine-readable medium including instructions for providing a vending machine interface system, which when executed by the vending machine interface system, cause the vending machine interface system to: receive data at the vending machine interface system, from a peripheral payment device connected to the vending machine interface system, the data indicating an amount received; determine a current price of a product; and communicate with a legacy vending machine controller of the vending machine to transmit a signal to the legacy vending machine controller, the signal causing the vending machine to dispense the product.

In Example 49, the subject matter of Example 48 optionally includes wherein the peripheral payment device is at least one of: a bill acceptor, a coin acceptor, or a card reader.

In Example 50, the subject matter of any one or more of Examples 48-49 optionally include instructions to access a corresponding legacy price of the product.

In Example 51, the subject matter of Example 50 optionally includes wherein the current price of the product and the corresponding legacy price of the product are different amounts.

In Example 52, the subject matter of any one or more of Examples 50-51 optionally include wherein the signal indicates that the amount received via the peripheral interface is at least that of the corresponding legacy price in order to cause the legacy vending machine controller to dispense the product.

In Example 53, the subject matter of any one or more of Examples 48-52 optionally include wherein the signal comprises a test vend signal.

In Example 54, the subject matter of any one or more of Examples 48-53 optionally include wherein the legacy vending machine controller is configured with a legacy price of zero for the product, and wherein the signal is a product selection signal.

In Example 55, the subject matter of any one or more of Examples 48-54 optionally include instructions to receive sensor data from a sensor installed in the vending machine.

In Example 56, the subject matter of Example 55 optionally includes wherein the sensor data indicates stock level of a product vended from the vending machine.

In Example 57, the subject matter of any one or more of Examples 55-56 optionally include wherein the sensor data indicates temperature of an interior space of the vending machine.

In Example 58, the subject matter of any one or more of Examples 55-57 optionally include instructions to communicate the sensor data to a remote location.

In Example 59, the subject matter of Example 58 optionally includes wherein the instructions to communicate the sensor data to the remote location comprise instructions to communicate the sensor data indicating stock level to a remote location to alert the remote location of a need to restock.

In Example 60, the subject matter of any one or more of Examples 48-59 optionally include instructions to establish connection with a human-machine interface of the vending machine.

In Example 61, the subject matter of Example 60 optionally includes wherein the human-machine interface is a keypad.

In Example 62, the subject matter of any one or more of Examples 60-61 optionally include instructions to: receive a product selection from the human-machine interface; and communicate the product selection to the legacy vending machine controller.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplated are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A vending machine interface system installed in a vending machine to retrofit the vending machine, the system comprising:

a peripheral interface to receive data from a peripheral payment device connected to the vending machine, the data indicating an amount received;

an inventory interface to determine a current price of a product and a corresponding legacy price of the product, the current price of the product advertised on the vending machine, and the legacy price of the product used by a legacy vending machine controller before and after the retrofit; and a vending machine controller interface to transmit a signal to the legacy vending machine controller when the amount received is at least the current price, the signal emulating the legacy price to the legacy vending machine controller, thereby providing a price translation between the current price and the legacy price, and causing the vending machine to dispense the product.

2. The system of claim 1, wherein the peripheral payment device is at least one of: a bill acceptor, a coin acceptor, or a card reader.

3. The system of claim 1, wherein the inventory interface is to access the corresponding legacy price of the product.

4. The system of claim 3, wherein the current price of the product and the corresponding legacy price of the product are different amounts.

5. The system of claim 3, wherein the signal indicates that the amount received via the peripheral interface is at least that of the corresponding legacy price in order to cause the legacy vending machine controller to dispense the product.

6. The system of claim 1, wherein the signal comprises a test end signal.

7. The system of claim 1, wherein legacy vending machine controller is configured with a legacy price of zero for the product, and wherein the signal is a product selection signal.

8. The system of claim 1, wherein the system further comprises a sensor interface to receive sensor data from a sensor installed in the vending machine.

9. The system of claim 8, wherein the sensor data indicates stock level of a product vended from the vending machine.

10. The system of claim 8, wherein the sensor data indicates temperature of an interior space of the vending machine.

11. The system of claim 8, wherein the system is to communicate the sensor data to a remote location.

12. The system of claim 11, wherein the system is to communicate the sensor data indicating stock level to a remote location to alert the remote location of a need to restock.

13. The system of claim 1, wherein the peripheral interface is connected to a human-machine interface of the vending machine, the human-machine interface used to select a product to vend from the vending machine.

14. The system of claim 13, wherein the human-machine interface is a keypad.

15. The system of claim 13, wherein the peripheral interface is to receive a product selection from the human-machine interface, and wherein the vending machine controller interface is to communicate the product selection to the legacy vending machine controller.

16. A method of providing a vending machine interface system installed in a vending machine to retrofit the vending machine, the method comprising:

receiving data at the vending machine interface system, from a peripheral payment device connected to the vending machine interface system, the data indicating an amount received;

determining a current price of a product and a corresponding legacy price of the product, the current price of the product advertised on the vending machine, and the legacy price of the product used by a legacy vending machine controller before and after the retrofit; and communicating with the legacy vending machine controller of the vending machine when the amount received is at least the current price, to transmit a signal to the legacy vending machine controller, the signal emulating the legacy price to the legacy vending machine controller, thereby providing a price translation between the current price and the legacy price, and causing the vending machine to dispense the product.

17. The method of claim 16, further comprising accessing the corresponding legacy price of the product.

18. The method of claim 17, wherein the current price of the product and the corresponding legacy price of the product are different amounts.

19. The method of claim 17, wherein the signal indicates that the amount received via the peripheral interface is at least that of the corresponding legacy price in order to cause the legacy vending machine controller to dispense the product.

20. The method of claim 16, wherein the signal comprises a test vend signal.

21. At least one non-transitory machine-readable medium including instructions for providing a vending machine interface system to retrofit the vending machine, which when executed by the vending machine interface system, cause the vending machine interface system to:

receive data at the vending machine interface system, from a peripheral payment device connected to the vending machine interface system, the data indicating an amount received;

determine a current price of a product and a corresponding legacy price of the product, the current price of the product advertised on the vending machine, and the legacy price of the product used by a legacy vending machine controller before and after the retrofit; and communicate with a legacy vending machine controller of the vending machine to transmit a signal to the legacy vending machine controller when the amount received is at least the current price, the signal emulating the legacy price to the legacy vending machine controller, thereby providing a price translation between the current price and the legacy price, and causing the vending machine to dispense the product.

22. The non-transitory machine-readable medium of claim 21, wherein the signal comprises a test vend signal.

23. The non-transitory machine-readable medium of claim 21, wherein the legacy vending machine controller is configured with a legacy price of zero for the product, and wherein the signal is a product selection signal.

24. The non-transitory machine-readable medium of claim 21, further comprising instructions to establish connection with a human-machine interface of the vending machine.

25. The non-transitory machine-readable medium of claim 24, further comprising instructions to:

receive a product selection from the human-machine interface; and communicate the product selection to the legacy vending machine controller.

* * * * *